US005704128A

United States Patent [19]

Lin

[11] Patent Number: 5,704,128

[45] Date of Patent: Jan. 6, 1998

[54] HAIRCUTTING DEVICE

[76] Inventor: Shih-wei Lin, No. 23, Yihsien Chuang, Nanyang Rd., 19th Lin, Yangming Li., Fengyuan City, Taichung Hsien, Taiwan

[21] Appl. No.: 661,429

[22] Filed: Jun. 11, 1996

[51] Int. Cl.[6] ..... B26B 13/24

[52] U.S. Cl. ..... 30/133; 30/201

[58] Field of Search ..... 30/133, 132, 200, 30/201, 202

[56] References Cited

U.S. PATENT DOCUMENTS 4,216,581 8/1980 Van Slooten ..... 30/133

*Primary Examiner*—Douglas D. Watts

*Attorney, Agent, or Firm*—Quarles & Brady

[57] ABSTRACT

A haircutting device includes a housing having a first opening defined in an underside thereof. A body is adjustably mounted in the housing and has a second opening defined in an underside thereof and communicating with the first opening. A haircutting mechanism is mounted on the underside of the body and located above the second opening. A suction member is mounted in the housing and includes a suction vent defined in an underside thereof and located above the haircutting mechanism. The suction member is operated to draw air from the housing through the first and second openings into the suction vent.

5 Claims, 7 Drawing Sheets

HAIRCUTTING DEVICE

FIELD OF THE INVENTION

The present invention relates to a haircutting device.

BACKGROUND OF THE INVENTION

Scissors, clippers and the like are usually used as haircutting implements for cutting and trimming a person's hair. However, hair that has been cut by the haircutting implements directly falls onto the floor or onto the person's neck, thereby easily causing an uncomfortable sensation to the person and an inconvenience in disposal of the cut hair.

The present invention has arisen to mitigate and/or obviate the disadvantages of the conventional haircutting implements.

SUMMARY OF THE INVENTION

In accordance with one aspect of the present invention, there is provided a haircutting device comprising a housing having a first opening defined in an underside thereof. A body is adjustably mounted in the housing and has a second opening defined in an underside thereof and communicating with the first opening.

A haircutting mechanism is mounted on the underside of the body and located above the second opening. A suction member is mounted in the housing and includes a suction vent defined in an underside thereof and located above the haircutting mechanism. The suction member is operated to draw air from the housing through the first and second openings into the suction vent.

Further features of the present invention will become apparent from a careful reading of the detailed description provided hereinbelow, with appropriate reference to the accompanying drawings.

DETAILED DESCRIPTION OF THE PREFERRED EMBODIMENTS

Figure 1:
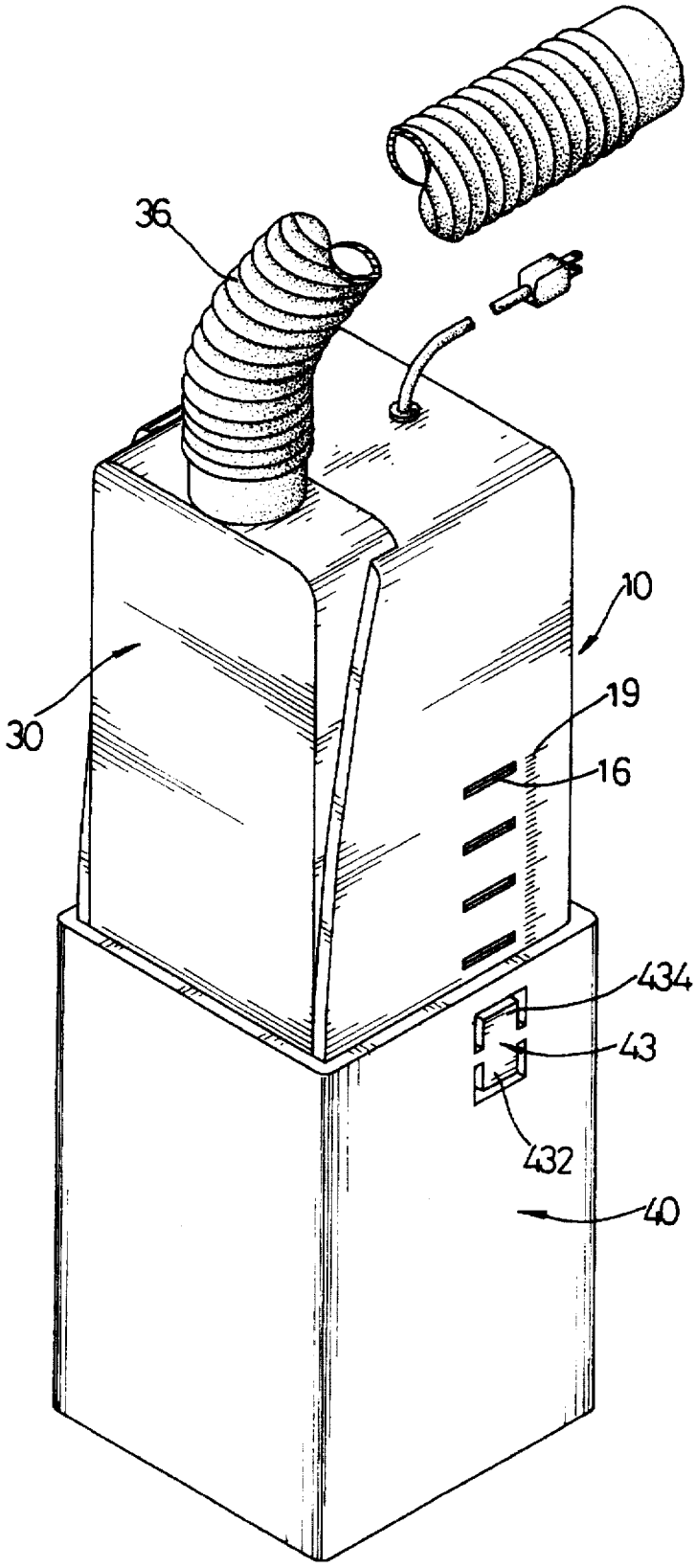
FIG. 1 is a perspective view of a haircutting device in accordance with the present invention.
Figure 2:
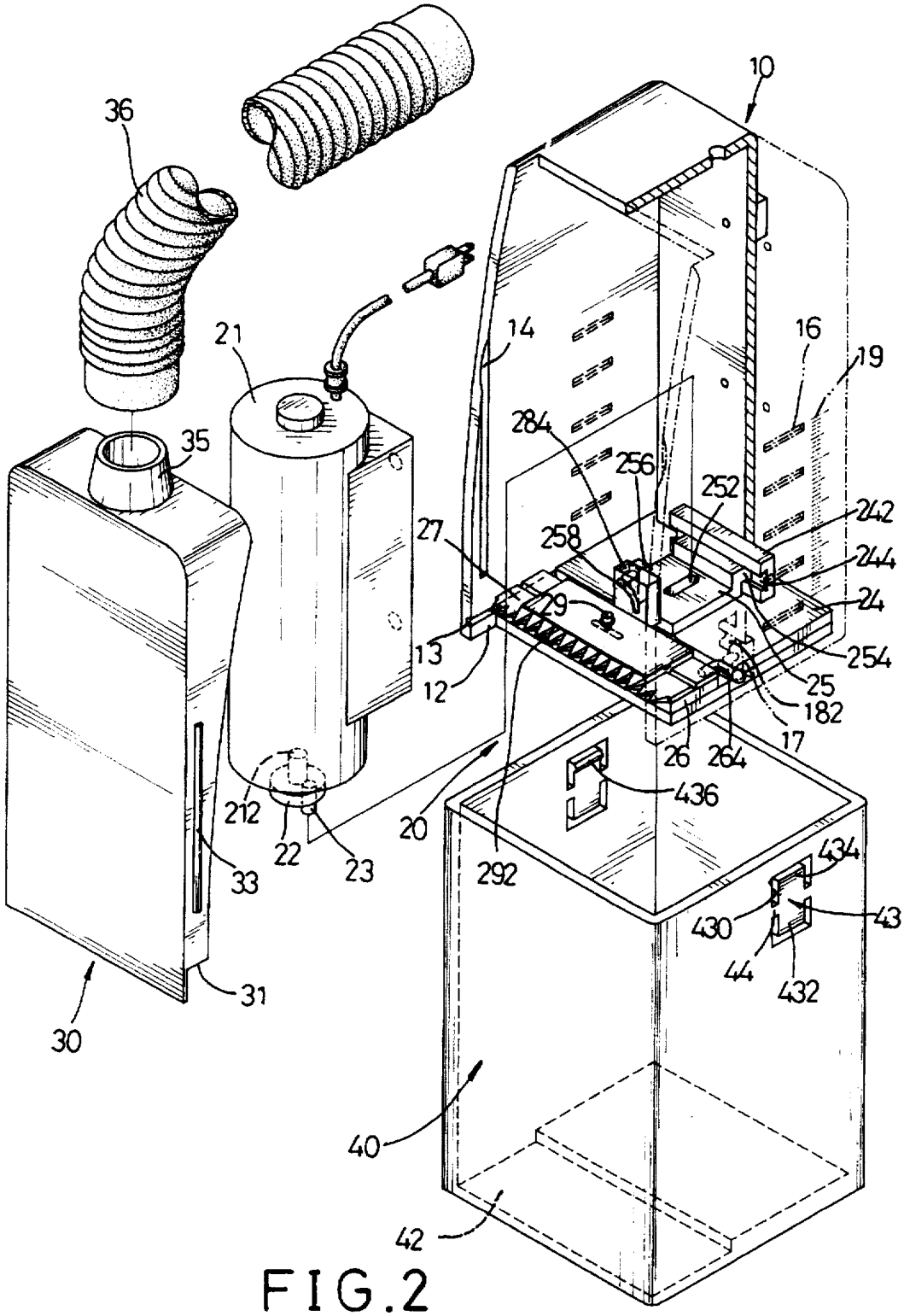
FIG. 2 is a partially cut-away exploded view of FIG. 1.
Figure 3:
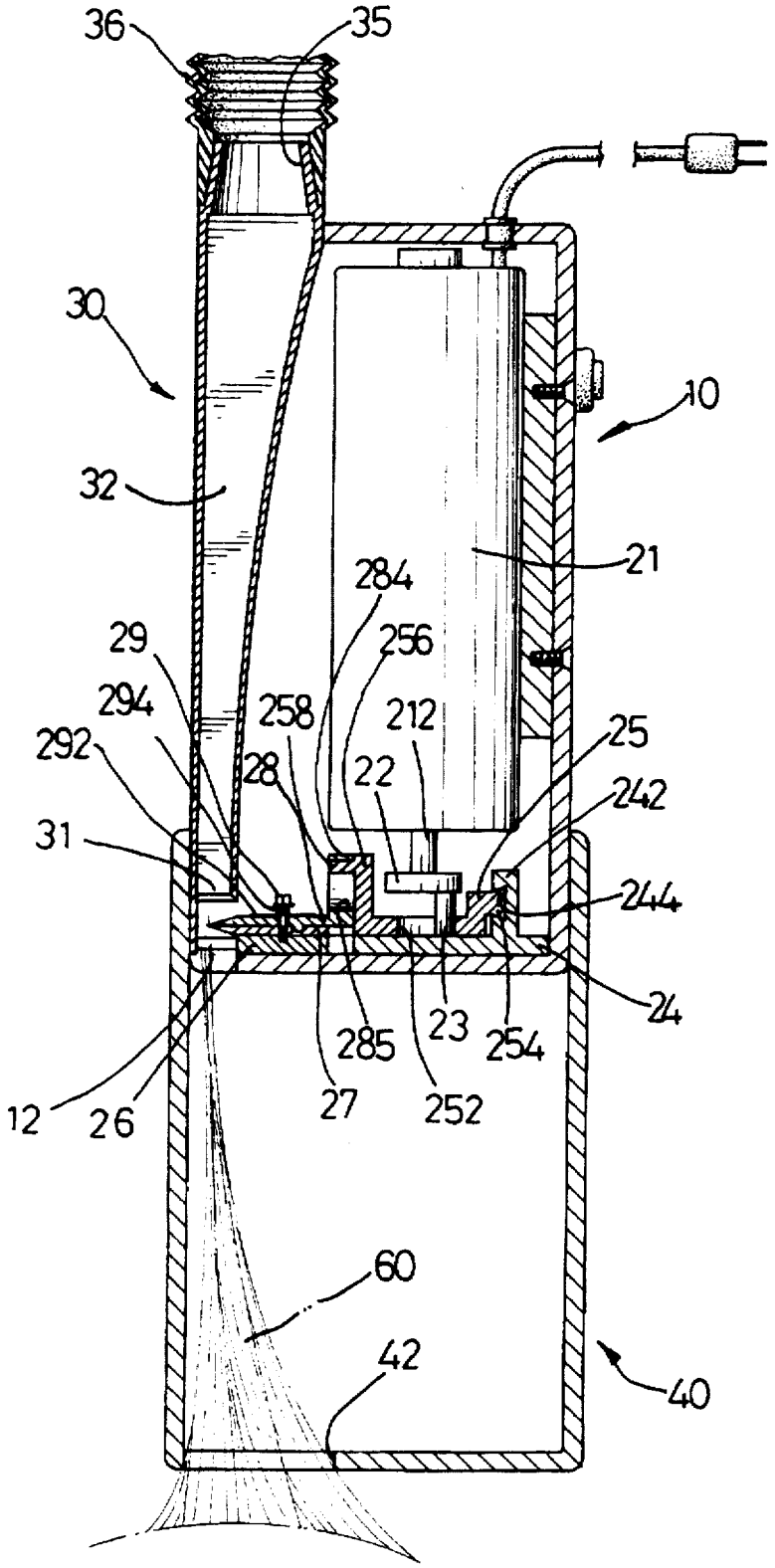
FIG. 3 is a side cross-sectional view of FIG. 1.
Figure 4:
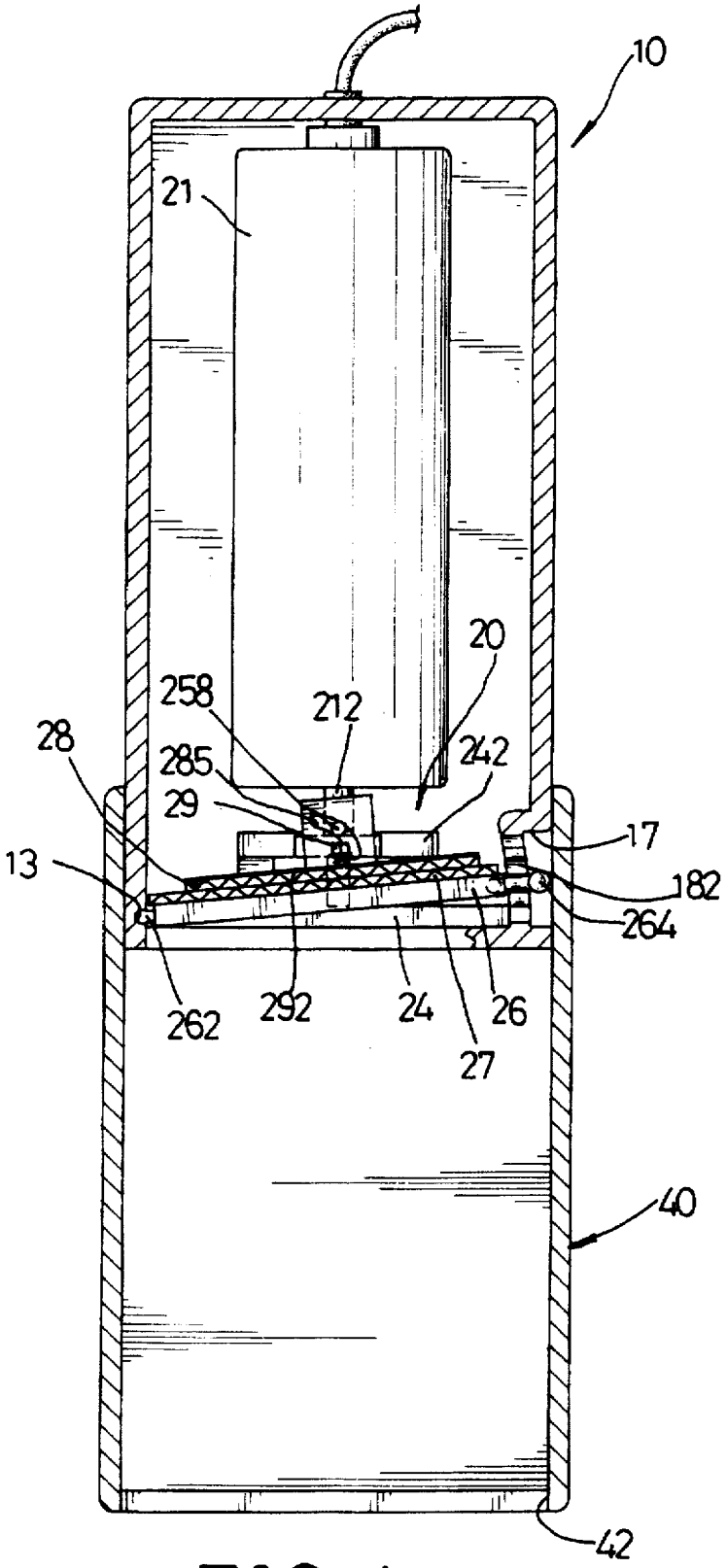
FIG. 4 is a front plan cross-sectional view of FIG. 1.

Referring to the drawings, and initially to FIGS. 1–3, a haircutting device in accordance with the present invention comprises a housing 40 having a first opening 42 defined in an underside thereof. A hollow body 10 is adjustably mounted in the housing 40 and has a second opening 12 defined in an underside thereof and communicating with the first opening 42. A haircutting mechanism 20 is mounted on the underside of the body 10 and located above the second opening 12. A suction member 30 is securely coupled with the body 10 and is adjustably mounted in the housing 40.

Preferably, the body 10 has two side walls each having a groove 14 vertically defined therein. The suction member 30 has two side walls each having a rib 33 vertically formed thereon and received in an associated groove 14 such that the suction member 30 is coupled with the body 10.

Referring to FIGS. 2–5, the haircutting mechanism 20 comprises a base plate 26 mounted on the underside the body 10. A lower cutting piece 27 is fixedly mounted on the base plate 26 and has a plurality of first blades 272 located above the second opening 12, and a hole 276 defined by a threaded periphery is defined in the lower cutting piece 27.

An upper cutting piece 28 is slidably mounted on the lower cutting piece 27 and has a plurality of second blades 281 located above the plurality of first blades 272. An elongate slot 283 is defined in the upper cutting piece 28 and communicates with the threaded hole 276. An upright wall 284 extends from one side of the upper cutting piece 28 and has an arcuate slot 285 defined therein.

A pressing plate 292 is mounted on the upper cutting piece 28 and has a bore 293 defined therein and communicating with the elongate slot 283. A positioning bolt 29 extends through the bore 293 and the elongate slot 283, and is threadedly engaged in the threaded hole 276. A biasing member 294 is mounted between the positioning bolt 29 and the pressing plate 292.

A positioning plate 24 is fixedly mounted on the underside of the body 10 and is located adjacent to the base plate 26. A guiding block 242 is fixedly mounted on the positioning plate 24 and has a dovetail-shaped groove 244 laterally defined therein.

A sliding plate 25 is slidably mounted on the positioning plate 24 and has an elongate slot 252 defined therein. A dovetail-shaped extension 254 extends from a first side of the sliding plate 25 and is slidably mounted in the dovetail-shaped groove 244. An upright arm 256 extends from a second side of the sliding plate 25 and is located adjacent to the upright wall 284. A rod 258 horizontally extends from the upright arm 256 and is slidably received in the arcuate slot 285.

A motor 21 is fixedly mounted in the body 10. A rotary shaft 212 is rotatably mounted on an underside of the motor 21. A rotary disk 22 is fixedly mounted on the rotary shaft 212. An upright rod 23 is fixedly mounted on a periphery of the rotary disk 22 to rotate therewith and is slidably received in the elongate slot 252.

Figure 5:
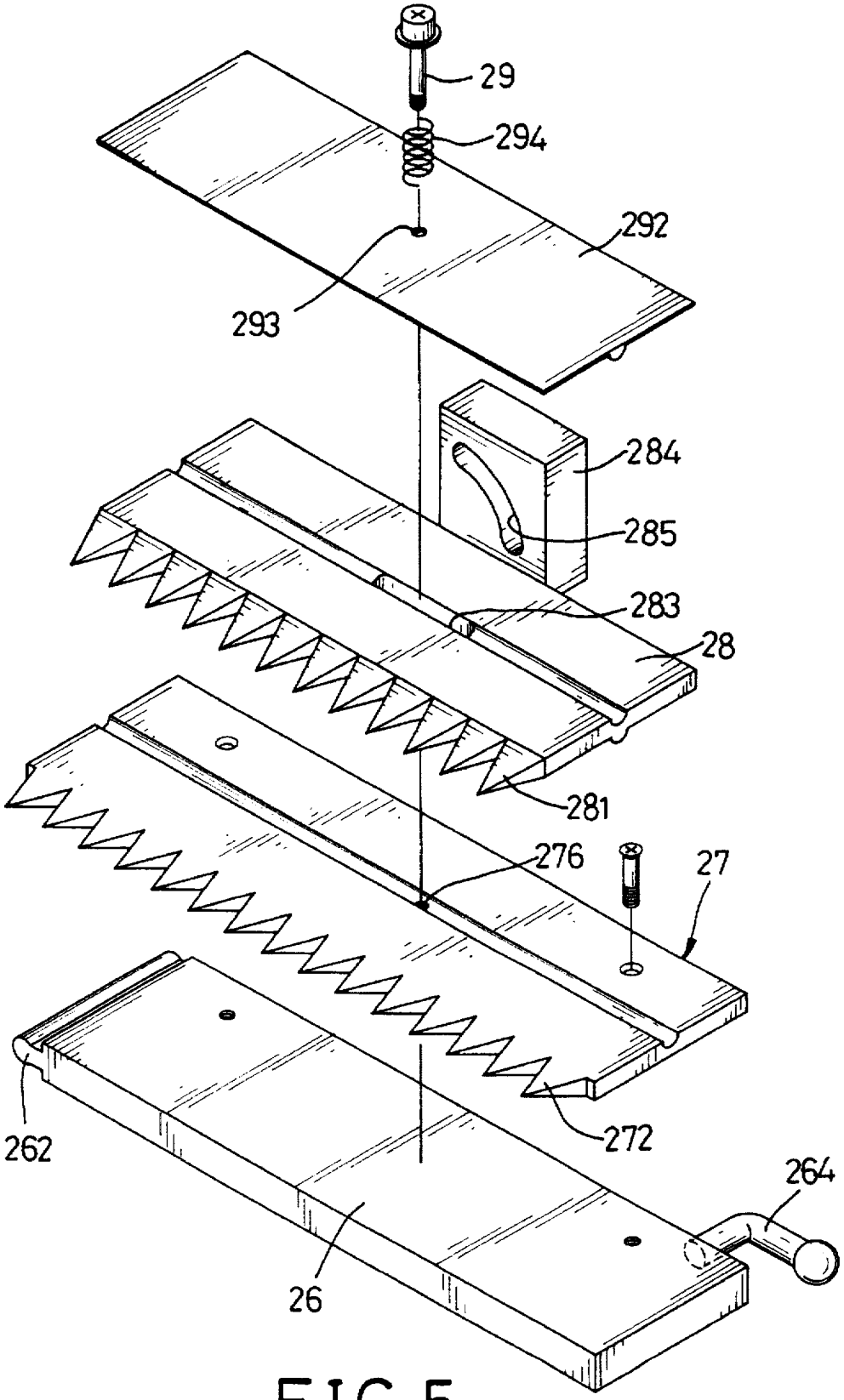
FIG. 5 is an enlarged exploded view of a cutting mechanism.
Figure 6:
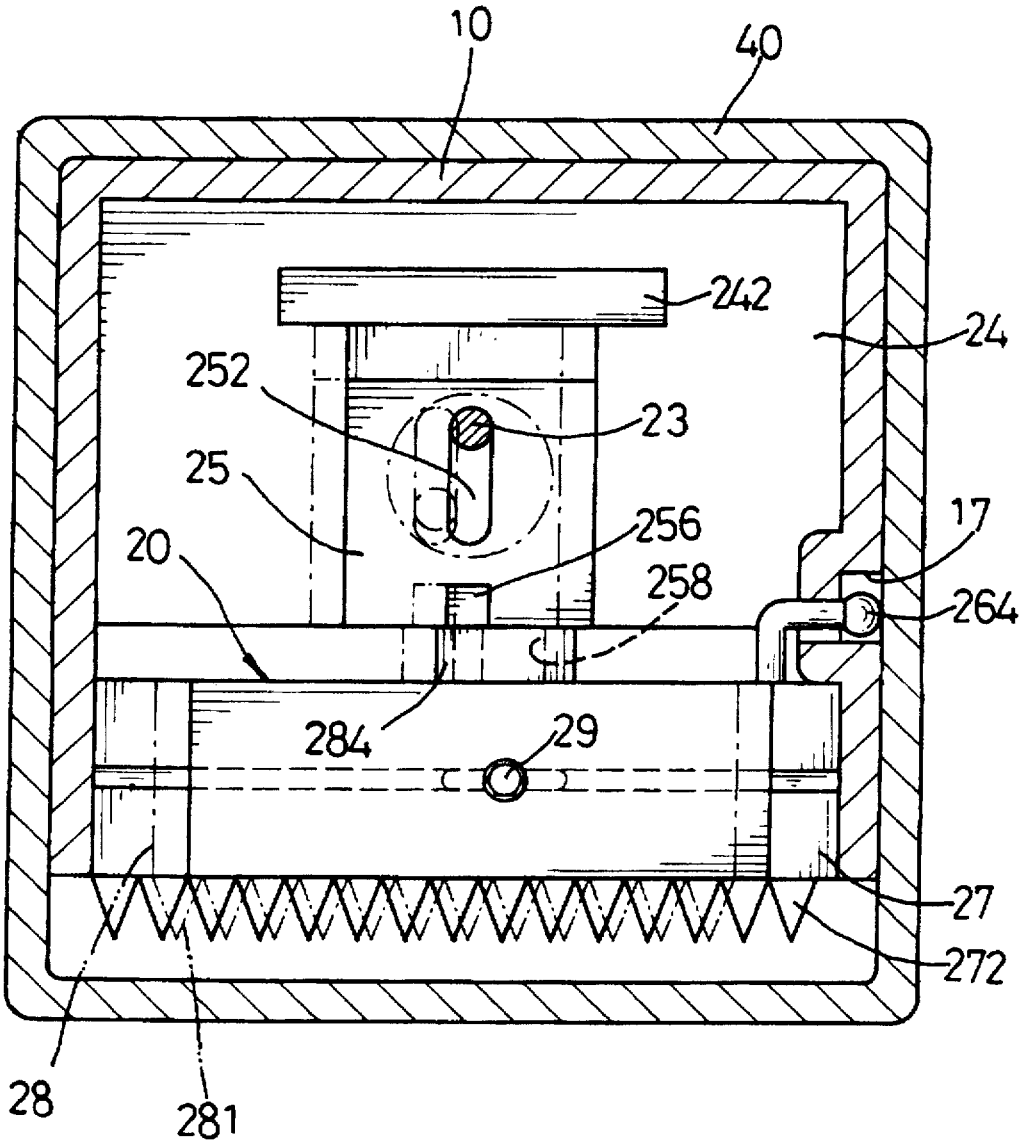
FIG. 6 is a top plan cross-sectional view of FIG. 1.

In operation, referring to FIGS. 5 and 6 with reference to FIGS. 2 and 3, the rotary disk 22 can be driven by means of the motor 21 to rotate the upright rod 23 which can slide in the elongate slot 252 so as to move the sliding plate 25 to a position as shown in phantom lines in FIG. 6, thereby moving the upright wall 284 by means of the rod 258 retained in the arcuate slot 285 so as to move the upper cutting piece 28 relative to the lower cutting piece 27.

Referring to FIGS. 2–5, the body 10 has a first side wall and a second side wall. A groove 13 is transversely defined in an underside of the first side wall of the body 10. A cavity 17 is defined in the second side wall of the body 10. A plurality of teeth 182 are formed on and extends inwardly from the second side wall of the body 10 and located adjacent to the cavity 17.

The base plate 26 has a rib 262 formed on a first end thereof and pivotally received in the groove 13, and has an adjusting rod 264 formed on a second end thereof and detachably retained by one of the plurality of teeth 182.

By such an arrangement, the base plate 26 can be pivoted relative to the first side wall of the body 10, thereby adjusting an inclination angle of the base plate 26.

Figure 7:
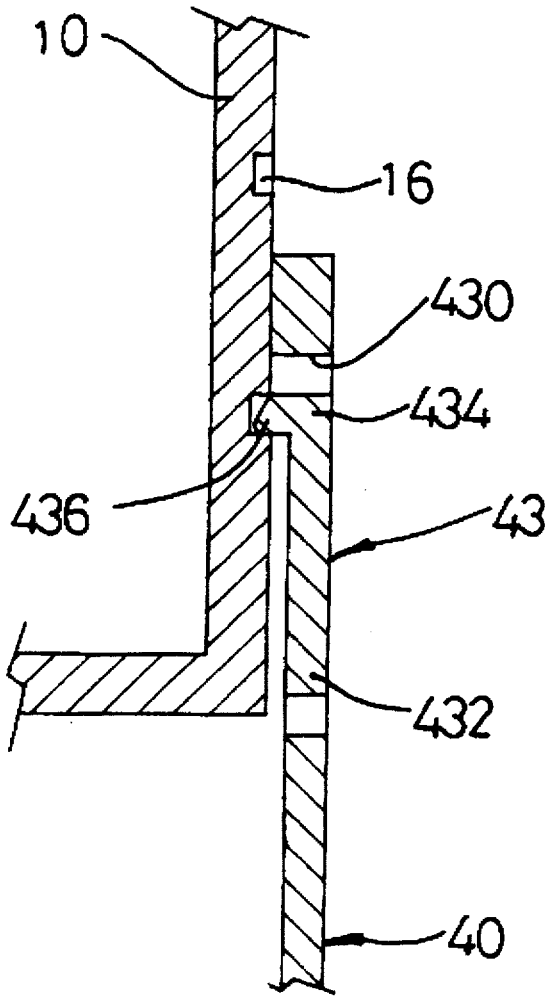
FIG. 7 is a cross-sectional view showing an engagement between a snapping member and a dent.

Referring to FIGS. 2 and 7, a plurality of indents 16 are defined in the two side walls of the body 10, and a plurality of graduations 19 are formed on the two side walls of the body 10 and align with the plurality of indents 16 respectively.

The housing 40 includes two side walls each having a snapping member 43 formed thereon. The snapping member 43 is formed by defining two opposite U-shaped cavities 430 in each of the two side walls of the housing 40, thereby forming an upper end 434 with a hook 436 extending inwardly therefrom, a lower end 432, and two ribs 44 for connecting the snapping member 43 to the side wall of housing 40. The hook 436 can be snapped in one of the plurality of indents 16 and can be detached from the associated indent 16 by pressing the lower end 432 such that the body can be adjustably mounted in the housing 40.

Again referring to FIGS. 2 and 3, the suction member 30 has a chamber 32 defined therein and a suction vent 31 defined in an underside thereof and located above the upper and lower cutting pieces 28 and 27. The suction member 30 also includes a connector 35 formed on an upperside thereof and connected with a hose 36 which is attached to a suction device such as a vacuum cleaner (not shown) and the like, thereby capable of drawing air from the housing 40 into the chamber 32 via the suction vent 31 and the opening 12.

By such an arrangement, referring to FIG. 3, the haircutting device can be used to cutting and trimming a person's hair 60 by the opening 42 of the housing 40 located above his/her hair. Then, the suction member 30 can be operated by the vacuum cleaner so as to draw hair 60 upwardly into the opening 12. The upper cutting piece 28 can then be operated by the motor 21 to move relative to the lower cutting piece 27, thereby cutting away hair 60 drawn through the opening 12, and the cut-away hair can be drawn into the chamber 32 via the suction vent 31 and then taken away by the vacuum cleaner via the hose 36.

It should be clear to those skilled in the art that further embodiments of the present invention may be made without departing from disclosures of the present invention.

What is claimed is:

1. A haircutting device comprising:

a housing defining a first opening in an underside thereof;

a body adjustably mounted in said housing and defining a second opening in an underside thereof and communicating with said first opening, a haircutting mechanism mounted on the underside of said body and located above said second opening, said haircutting mechanism comprising:

a base plate mounted on the underside of said body;

a lower cutting piece fixedly mounted on said base plate and having a plurality of first blades located above said second opening, and a threaded hole defined in said lower cutting piece;

an upper cutting piece slidably mounted on said lower cutting piece and having a plurality of second blades located above said plurality of first blades, and an elongate slot defined in said upper cutting piece and communicating with said threaded hole of said lower cutting piece;

a pressing plate mounted on said upper cutting piece and defining a bore therein which communicates with said elongate slot;

a positioning bolt extending through said bore and said elongate slot, and threadedly engaged with said threaded hole; and a biasing member mounted between said positioning bolt and said pressing plate; and a suction member mounted in said housing and including a suction vent defined in an underside thereof and located above said haircutting mechanism, said suction member being operated to draw air from said housing through said first and second openings and into said suction vent.

2. The haircutting device in accordance with claim 1, wherein said haircutting mechanism further comprises:

a positioning plate fixedly mounted on the underside of said body and located adjacent to said base plate, a guiding block fixedly mounted on said positioning plate and having a dovetail-shaped groove laterally defined therein;

a sliding plate slidably mounted on said positioning plate, a dovetail-shaped extension extending from a first side of said sliding plate and slidably mounted in said dovetail-shaped groove;

an upright arm extending from a second side of said sliding plate, a rod horizontally extending from said upright arm; and an upright wall extending from said upper cutting piece and located adjacent to said upright arm, an arcuate slot defined in said upright wall for receiving said rod therein.

3. The haircutting device in accordance with claim 2, wherein said sliding plate defines an elongate slot therein, said haircutting mechanism further comprising a motor fixedly mounted in said body, a rotary disk rotatably mounted on an underside of said motor an upright rod fixedly mounted on a periphery of said rotary disk to rotate therewith and slidably received in said elongate slot.

4. The haircutting device in accordance with claim 1, wherein said body has a first side wall and a second side wall, a groove transversely defined in the first side wall of said body, a plurality of teeth formed on and extending inwardly from the second side wall of said body, said base plate having a rib formed on a first end thereof and pivotally received in said groove, and having an adjusting rod formed on a second end thereof and detachably retained by one of said plurality of teeth.

5. The haircutting device in accordance with claim 4, wherein a plurality of indents are defined in at least one of the first and second side walls of said body, and said housing includes a hook formed on and extending inwardly from one side wall thereof and snapped in one of said plurality of indents.

* * * * *